US006204826B1

(12) United States Patent
Rutkowski et al.

(10) Patent No.: US 6,204,826 B1
(45) Date of Patent: Mar. 20, 2001

(54) FLAT DUAL FREQUENCY BAND ANTENNAS FOR WIRELESS COMMUNICATORS

(75) Inventors: Kim Rutkowski, Raleigh; Gerard James Hayes, Wake Forest, both of NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/359,729

(22) Filed: Jul. 22, 1999

(51) Int. Cl.[7] ..... H01Q 1/36

(52) U.S. Cl. ..... 343/895; 343/700 MS; 343/872

(58) Field of Search ..... 343/895, 702, 343/700 MS, 872, 793, 803, 804, 866; 455/90

(56) References Cited

U.S. PATENT DOCUMENTS 5,986,609 * 11/1999 Spall ..... 343/700 MS
5,986,616 * 11/1999 Edvardsson ..... 343/895
6,016,126 * 1/2000 Holshouser ..... 343/702
6,040,803 * 3/2000 Spall ..... 343/895
6,069,592 * 5/2000 Wass ..... 343/895

FOREIGN PATENT DOCUMENTS 0 520 197 A2 5/1992 (EP) ..... H01Q/1/08
0 923 158 A2 6/1999 (EP) ..... H01Q/9/30

OTHER PUBLICATIONS

International Search Report dated Oct. 13, 2000, International Application No. PCT/US00/16516.

* cited by examiner

*Primary Examiner*—Don Wong
*Assistant Examiner*—Thuy Vinh Tran
(74) *Attorney, Agent, or Firm*—Myers Bigel Sibley & Sajovec

(57) ABSTRACT

A dual frequency band antenna includes a dielectric substrate having opposite first and second surfaces and a meandering conductive trace disposed on a surface of the dielectric substrate. The meandering conductive trace includes first and second meandering segments that are configured to electrically couple with each other such that the antenna resonates within two separate and distinct frequency bands. At least one of the first and second meandering segments has a portion with an increased width compared with the width of the conductive trace.

16 Claims, 3 Drawing Sheets

FLAT DUAL FREQUENCY BAND ANTENNAS FOR WIRELESS COMMUNICATORS

FIELD OF THE INVENTION

The present invention relates generally to antennas, and more particularly to antennas used with wireless communications devices.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems.

Radiotelephones typically include an antenna for transmitting and/or receiving wireless communications signals. Historically, monopole and dipole antennas have perhaps been most widely employed in various radiotelephone applications, due to their simplicity, wideband response, broad radiation pattern, and low cost.

However, radiotelephones and other wireless communications devices are undergoing miniaturization. Indeed, many contemporary radiotelephones are less than 11–12 centimeters in length. As a result, antennas utilized by radiotelephones have also undergone miniaturization. In addition, it is becoming desirable for radiotelephones to be able to operate within widely separated frequency bands in order to utilize more than one communications system. For example, GSM (Global System for Mobile communication) is a digital mobile telephone system that typically operates at a low frequency band, such as between 880 MHz and 960 MHz. DCS (Digital Communication System) is a digital mobile telephone system that typically operates at high frequency bands between 1710 MHz and 1880 MHz.

Small radiotelephone antennas typically operate within narrow frequency bands. As a result, it can be difficult for conventional radiotelephone antennas to operate over widely separated frequency bands. Furthermore, as radiotelephone antennas become smaller, the frequency bands within which they can operate typically become narrower.

Helix antennas are increasingly being utilized in handheld radiotelephones that operate within multiple frequency bands. Helix antennas typically include a conducting member wound in a helical pattern. As the radiating element of a helix antenna is wound about an axis, the axial length of the helix antenna can be considerably less than the length of a comparable monopole antenna. Thus, helix antennas may often be employed where the length of a monopole antenna is prohibitive.

FIG. 1 illustrates a conventional helix antenna 5 configured for dual frequency band operation. As shown in FIG. 1, the antenna 5 generally includes an antenna feed structure 6, a radiating element 7, and a parasitic element 8. The radiating element 7 and parasitic element 8 are housed within a plastic tube or radome 9 with an end cap 10. Unfortunately, helix antennas can be somewhat complex to manufacture, particularly with regard to positioning of the radiating and parasitic elements 7, 8.

Branch antennas are also being utilized in handheld radiotelephones that operate within multiple frequency bands. Branch antennas typically include a pair of conductive traces disposed on a substrate that serve as radiating elements and that diverge from a single feed point. FIG. 2 illustrates a conventional branch antenna 15 configured for dual frequency band operation. As shown in FIG. 2, the antenna 15 generally includes a flat substrate 16 having a pair of meandering radiating elements 17*a*, 17*b* disposed thereon. The meandering radiating elements 17*a*, 17*b* diverge from a feed point 18 that electrically connects the antenna 15 to RF circuitry within a radiotelephone.

Each of the meandering radiating elements 17*a*, 17*b* is configured to resonate within a respective frequency band.

Unfortunately, branch antennas may transmit and receive electrical signals within a band of frequencies that are too narrow for radiotelephone operation. Furthermore, in order to decrease the size of a branch antenna, it is typically necessary to compress the meandering pattern of each radiating element. Unfortunately, as the meandering pattern of a radiating element becomes more compressed, the frequency band within which the radiating element can operate typically becomes more narrow.

Thus, in light of the above-mentioned demand for multiple frequency band radiotelephones and the problems with conventional antennas for such radiotelephones, a need exists for small radiotelephone antennas that are capable of operating in multiple widely separated frequency bands.

SUMMARY OF THE INVENTION

It is, therefore, an object of the present invention to provide small antennas for wireless communicators, such as radiotelephones, that are capable of operating in multiple widely separated frequency bands.

It is also an object of the present invention to facilitate radiotelephone miniaturization.

These and other objects of the present invention can be provided by an antenna having a continuous radiating element disposed on a dielectric substrate surface wherein meandering segments of the continuous radiating element are configured to couple with each other thereby causing the antenna to resonate within different first and second frequency bands. The continuous radiating element is a conductive trace (e.g., copper trace) that includes a first end electrically connected to a feed point and an opposite free end.

A first meandering segment of the conductive trace extends from the first end to an intermediate segment between the first end and the free end. The intermediate segment is spaced apart from the conductive trace first end preferably by a distance of less than or equal to about 2 millimeters (mm). However, the distance between the intermediate segment and the conductive trace first end may vary depending on the geometry of the antenna and the resonant frequencies at which the antenna is desired to resonate. A second meandering segment of the conductive trace extends from the intermediate segment to the free end. The conductive trace first and second meandering segments are configured to electrically couple with each other such that the antenna resonates at two separate and distinct (i.e., low and high) frequency bands.

The conductive trace has a substantially constant width except for a portion of the first or second meandering segments which has an increased width. The portion with the increased width is a tuning parameter which can affect the frequency band and center frequency of both the low and high frequency bands.

According to another embodiment of the present invention, a conductive element may be disposed on the second surface of the dielectric substrate in overlying juxtaposition with one or both of the conductive trace first and second meandering segments. The conductive element is configured to parasitically couple with at least one of the conductive trace first and second meandering segments to thereby affect the frequency band and center frequency within which the antenna resonates.

Antennas according to the present invention are particularly well suited for operation within various communications systems utilizing multiple frequency bands. Furthermore, because of their small size, antennas according to the present invention can be utilized within very small communications devices. In addition, because a single substrate is utilized, antennas according to the present invention can be easier to manufacture than conventional dual-band antennas.

DETAILED DESCRIPTION OF THE INVENTION

Figure 1:
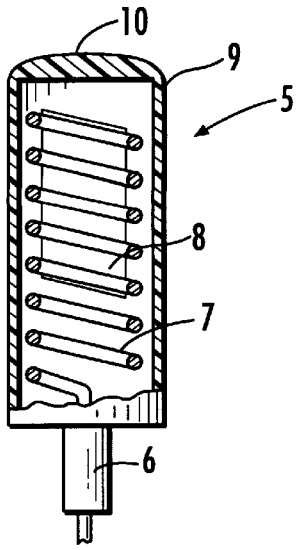
FIG. 1. (PRIOR ART)
FIG. 1 is a side section view of a conventional helix antenna that is configured for dual frequency band radiotelephone operation.
Figure 2:
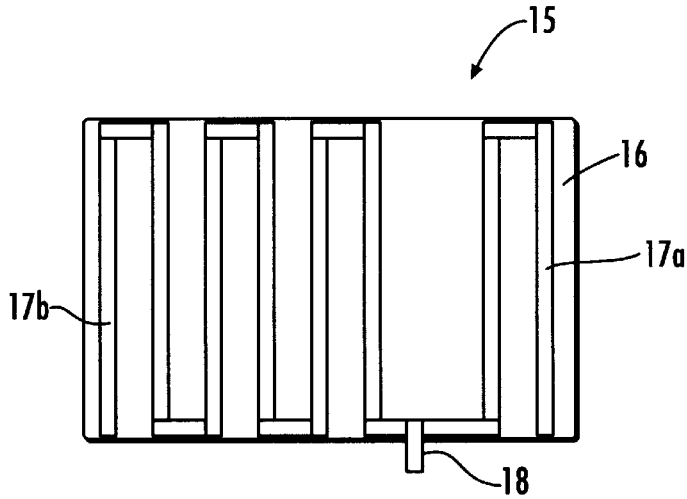
FIG. 2. (PRIOR ART)
FIG. 2 is a plan view of a conventional branch antenna that is configured for dual frequency band radiotelephone operation.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present. Moreover, each embodiment described and illustrated herein includes its complementary conductivity type embodiment as well.

Figure 3:
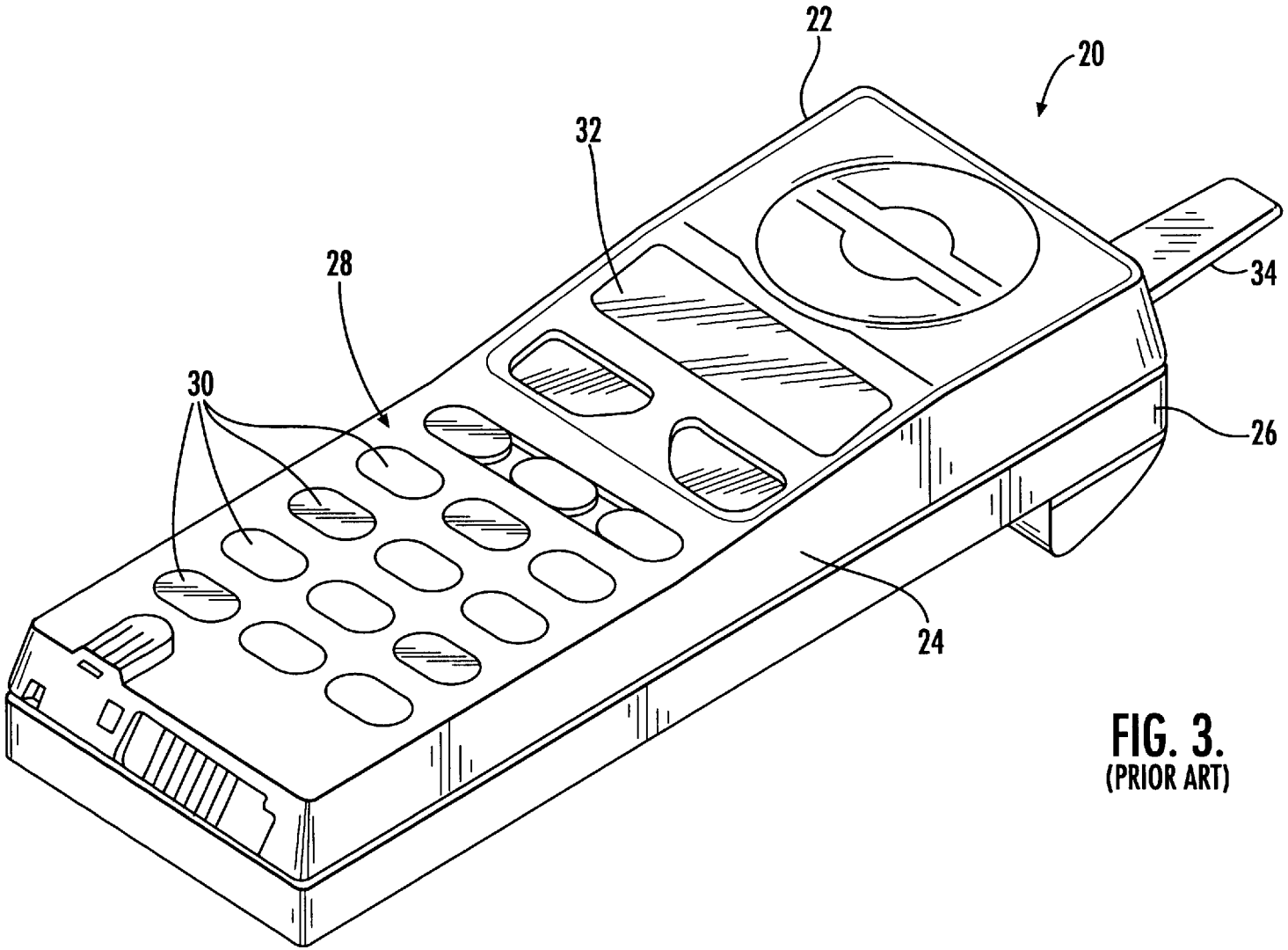
FIG. 3. (PRIOR ART)
FIG. 3 is a perspective view of an exemplary radiotelephone within which an antenna according to the present invention may be incorporated.

Referring now to FIG. 3, a radiotelephone 20 within which an antenna according to the present invention may be incorporated is illustrated. The housing 22 of the illustrated radiotelephone 20 includes a top portion 24 and a bottom portion 26 connected thereto to form a cavity therein. Top and bottom housing portions 24, 26 house a keypad 28 including a plurality of keys 30, a display 32, and electronic components (not shown) that enable the radiotelephone 20 to transmit and receive radiotelephone communications signals. An antenna according to the present invention may be located within the illustrated radome 34.

Figure 4:
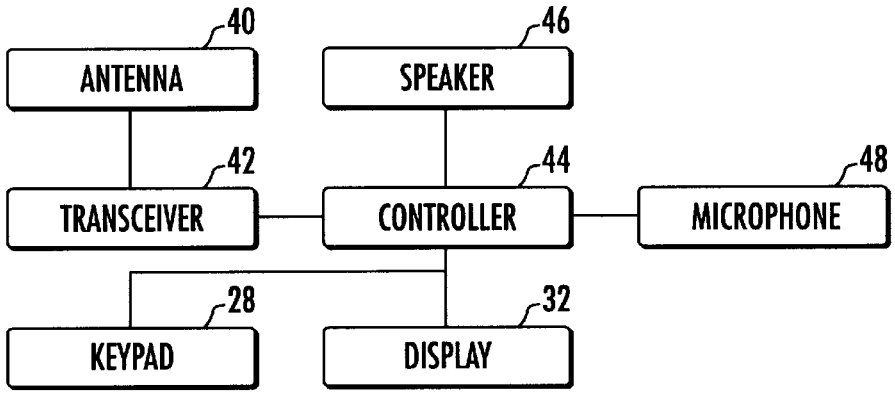
FIG. 4. (PRIOR ART)
FIG. 4 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 4, and is understood by those skilled in the art of radiotelephone communications. An antenna 40 for receiving and transmitting radiotelephone communication signals is electrically connected to a radio-frequency transceiver 42 that is further electrically connected to a controller 44, such as a microprocessor. The controller 44 is electrically connected to a speaker 46 that transmits a remote signal from the controller 44 to a user of a radiotelephone. The controller 44 is also electrically connected to a microphone 48 that receives a voice signal from a user and transmits the voice signal through the controller 44 and transceiver 42 to a remote device. The controller 44 is electrically connected to a keypad 28 and display 32 that facilitate radiotelephone operation.

Antennas according to the present invention may also be used with wireless communications devices which only transmit or receive radio frequency signals. Such devices which only receive signals may include conventional AM/FM radios or any receiver utilizing an antenna. Devices which only transmit signals may include remote data input devices.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency (RF) energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the feed point.

Figure 5:
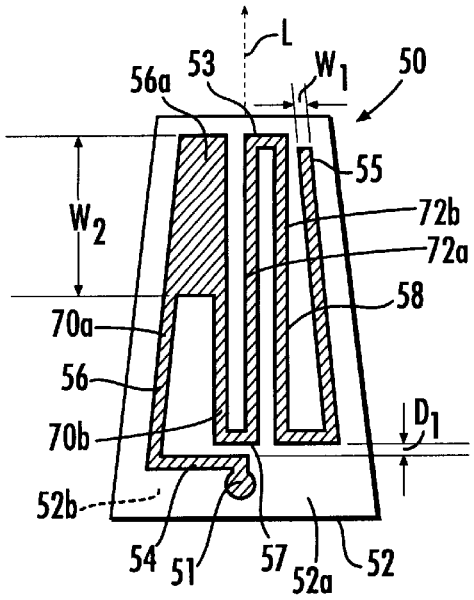
FIG. 5 is a plan view of an antenna according to an embodiment of the present invention that is configured for dual frequency band radiotelephone operation, wherein a portion of the first meandering segment has an increased width.
Figure 6:
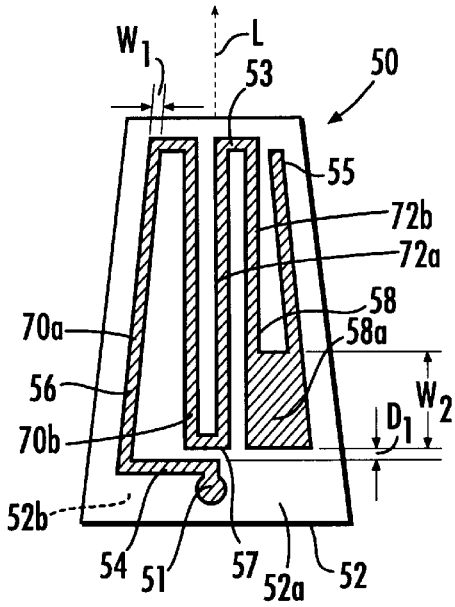
FIG. 6 is a plan view of an antenna according to another embodiment of the present invention that is configured for dual frequency band radiotelephone operation, wherein a portion of the second meandering segment has an increased width.

Referring now to FIGS. 5 and 6, a dual frequency band antenna 50 in accordance with an embodiment of the present invention is illustrated. The illustrated antenna 50 includes a dielectric substrate 52 having opposite first and second surfaces 52*a*, 52*b*. A feed point 51 is disposed on the dielectric substrate 52, as illustrated. A meandering conductive trace 53 is disposed on the dielectric substrate first surface 52*a*.

A particularly preferable material for use as the dielectric substrate 52 is FR4 or polyimide, which are well known to those having skill in the art of communications devices. However, various dielectric materials may be utilized for the dielectric substrate 52. Preferably, the dielectric substrate 52 has a dielectric constant between about 2 and about 4 for the illustrated embodiment. However, it is to be understood that dielectric substrates having different dielectric constants may be utilized without departing from the spirit and intent of the present invention.

Figure 7:
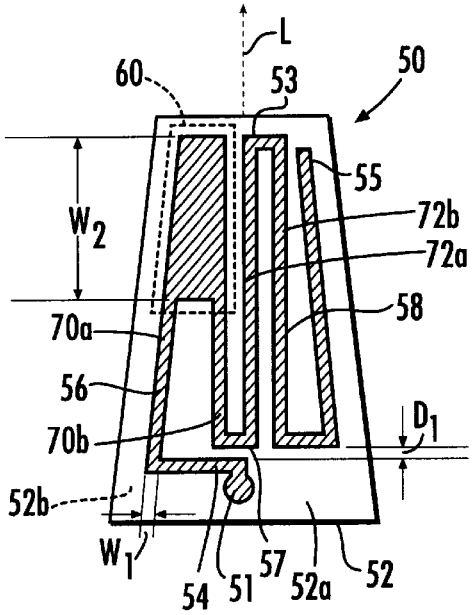
FIG. 7 is a plan view of the antenna of FIG. 5 with a conductive element disposed on the second surface of the dielectric substrate in overlying juxtaposition with the conductive trace first meandering segment.

The meandering conductive trace 53 includes a first end 54 electrically connected to the feed point 51 and an opposite free end 55. As is known to those of skill in the art, the feed point 51 electrically connects the antenna 50 to RF circuitry within a wireless communicator, such as a radiotelephone. A first meandering segment 56 extends from the first end 54 to an intermediate segment 57 between the first end 54 and the free end 55 and has a pair of elongate converging legs 70*a*, 70*b* as illustrated in FIGS. 5–7. The elongate converging legs 70*a*, 70*b* converge along a longitudinal direction L. According to an embodiment of the present invention, the intermediate segment 57 is spaced apart from the conductive trace first end by a distance $D_1$ that is less than or equal to about 2 millimeters (mm). The intermediate segment 57 has a pair of elongate parallel legs 72*a*, 72*b* that are in adjacent, spaced-apart relationship with the elongate converging legs 70*a*, 70*b* of the first meandering segment 56, and that extend along the longitudinal direction L, as illustrated in FIGS. 5–7. Applicants respectfully submit that the amendments only serve to clarify the embodiments of the invention already illustrated in FIGS. 5–7 and that no new matter has been added. The distance $D_1$ between the intermediate segment 57 and the first end 54 of the conductive trace 53 is a tuning parameter which can affect the frequency band and center frequency within which the first and second meandering segments 56, 58 resonate. A second meandering segment 58 extends from the intermediate segment 57 to the free end 55.

The conductive trace first and second meandering segments 56, 58 may have equal or different electrical lengths. The first and second meandering segments 56, 58 are configured to electrically couple with each other such that two separate and distinct (i.e., low and high) frequency bands are created. The intermediate segment 57 may also couple with the first and second meandering segments 56, 58 to create two separate and distinct frequency bands. For example, the various segments of the conductive trace can be configured to resonate between 824 MHz and 960 MHz (i.e., a low frequency band) and between 1710 MHz and 1990 MHz (i.e., a high frequency band). As would be known by one of skill in the art, the term "coupling" refers to the association of two or more circuits or systems in such a way that power or signal information may be transferred from one to another.

In the illustrated embodiment of FIG. 5, the conductive trace 53 has a substantially constant width $W_1$ except for a portion 56*a* of the first meandering segment 56 which has a width $W_2$ greater than the width $W_1$ of the remaining segments of the conductive trace. The portion 56*a* may be formed by at least partially filling adjacent portions of the conductive trace 53 with conductive material.

Similarly in FIG. 6, the conductive trace 53 has a substantially constant width $W_1$ except for a portion 58*a* of the second meandering segment 58 which has a width $W_2$ greater than the width $W_1$ of the remaining segments of the conductive trace 53. The portion 58*a* may be formed by at least partially filling adjacent portions of the conductive trace 53 with conductive material. The width $W_2$ of the respective portion 56*a* (FIG. 5) of the first meandering segment 56 is a tuning parameter which can be adjusted to adjust the frequency bands and center frequencies of both resonant frequency bands. Similarly, the width $W_2$ of the respective portion 58*a* of the second meandering segment 58 is a tuning parameter which can be adjusted to adjust the frequency bands and center frequencies of both resonant frequency bands.

According to another embodiment of the present invention illustrated in FIG. 7, a conductive element 60 is disposed on the second surface 52*b* of the dielectric substrate 52. Preferably, the conductive element 60 is disposed on the dielectric substrate second surface 52*b* in overlying juxtaposition with one or both of the conductive trace first and second meandering segments 56, 58, (as well as with the intermediate segment 57). The conductive element 60 is configured to parasitically couple with at least one of the conductive trace first and second meandering segments 56, 58 to thereby affect the frequency band and center frequency within which one or both of the first and second meandering segments resonate. The dimensions of the conductive element 60 is a tuning parameter which can be adjusted to adjust the frequency band and center frequency within which either or both of the first and second segments 56, 58 can resonate.

The meandering patterns of the illustrated first and second meandering segments 56, 58 in FIGS. 5–7 may vary depending on the space limitations of the substrate outer surface 52*a*. The intermediate segment 57 may be spaced apart from the conductive trace first end 54 by a distance $D_1$ of less than or equal to about 2 millimeters (mm).

A preferred conductive material for use as the conductive trace 53 is copper. Typically, the thickness of the conductive trace 53 is between about 0.05–1.0 mm. As described above, the bandwidth of the antenna 50 may be adjusted by changing the configuration of the conductive trace 53, the width $W_2$ of the respective portions 56*a* and 58*a*, and the location and shape of a conductive element 60 disposed on the second surface 52*b*.

The low frequency bands of GSM are between about 880 MHz and 960 MHz, corresponding to a bandwidth of 80 MHz. The low frequency bands of AMPS (Advanced Mobile Phone Service) are between about 824 MHz and 894 MHz, corresponding to a bandwidth of 70 MHz. The high frequency bands of PCS (Personal Communications System) are between about 1850 MHz and 1990 MHz, corresponding to a bandwidth of 140 MHz. The high frequency bands of DCS are between about 1710 MHz and 1880 MHz, corresponding to a bandwidth of 170 MHz. Accordingly, for a radiotelephone antenna to operate adequately at a low frequency band (e.g., for GSM or AMPS), it should have a bandwidth of between about 70 MHz–80 MHz. Similarly, for a radiotelephone antenna to operate adequately at a high frequency band (e.g., for PCS or DCS), it should have a bandwidth of between about 140 MHz–170 MHz.

Table 1 below illustrates the bandwidth attainable by the illustrated antennas of FIGS. 5–7.

TABLE 1

| | Low Band | | High Band | |
|---|---|---|---|---|
| | Center Frequency of Resonance (MHz) | Bandwidth (MHz) of 2:1 VSWR | Center Frequency of Resonance (MHz) | Bandwidth (MHz) of 2:1 VSWR |
| Antenna with Constant Trace Width | 892 | 49.2 | 2,017 | 77 |
| Fig. 5 | 976 | 98.3 | 2,031 | 112 |
| Fig. 6 | 899 | 49.2 | 2,087 | 85 |
| Fig. 7 | 987 | 93.7 | 2,233 | 81 |

As illustrated in Table 1, an antenna similar to that illustrated in FIGS. 5 and 6, but wherein the conductive trace has a constant width throughout its entire length has a low band center frequency of 892 MHz with a bandwidth of 49.2 MHz and a high band center frequency of 2,017 MHz with a bandwidth of 77. The antenna of FIG. 5 has a low band center frequency of 976 MHz with a bandwidth of 98.3 MHz and a high band center frequency of 2,031 MHz with a bandwidth of 112. The antenna of FIG. 6 has a low band center frequency of 899 MHz with a bandwidth of 49.2 MHz and a high band center frequency of 2,087 MHz with a bandwidth of 85. The antenna of FIG. 7 has a low band center frequency of 987 MHz with a bandwidth of 93.7 MHz and a high band center frequency of 2,233 MHz with a bandwidth of 81.

As illustrated in Table 1, increasing the width of portions of the first or second meandering segments affects the bandwidth and the location of the center frequencies of both high and low frequency bands. The location and length of this increase in conductive trace width also determines which frequency band (low or high) is affected the most.

By increasing the width of the conductive trace 53, in the illustrated configuration, from $W_1$ to $W_2$ in the first meandering segment portion 56*a* illustrated in FIG. 5, the bandwidth of both the low frequency band and the high frequency band is increased, as illustrated in Table 1. Similarly, by increasing the width of the conductive trace 53 from $W_1$ to $W_2$ in the second meandering segment portion 58*a* illustrated in FIG. 6, the bandwidth of both the low frequency band and the high frequency band is increased.

It is to be understood that the present invention is not limited to the illustrated embodiments of FIGS. 5–7. Various other configurations incorporating aspects of the present invention may be utilized, without limitation.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A multiple frequency band antenna, comprising:

a dielectric substrate comprising opposite first and second surfaces;

a feed point disposed on the dielectric substrate; and a meandering conductive trace disposed on the dielectric substrate first surface, comprising:

a first end electrically connected to the feed point and an opposite free end;

an intermediate segment between the first end and the free end, comprising a pair of elongate parallel legs that define a longitudinal direction;

a first meandering segment extending from the first end to the intermediate segment, comprising a pair of elongate converging legs in spaced-apart adjacent relationship with the pair of elongate parallel legs of the intermediate segment, and that converge along the longitudinal direction;

a second meandering segment extending from the intermediate segment to the free end;

wherein the first and second meandering segments are configured to electrically couple with each other such that the antenna resonates within at least two separate and distinct frequency bands; and wherein a portion of at least one of the conductive trace first and second meandering segments has a second width greater than the first width.

2. A multiple frequency band antenna according to claim 1 wherein the intermediate segment is spaced apart from the conductive trace first end by a distance of less than or equal to about 2 millimeters (mm).

3. A multiple frequency band antenna according to claim 1 further comprising a conductive element disposed on the dielectric substrate second surface, wherein the conductive element is configured to parasitically couple with at least one of the conductive trace first and second meandering segments.

4. A multiple frequency band antenna according to claim 3 wherein the conductive element is disposed on the dielectric substrate second surface in overlying juxtaposition with at least one of the conductive trace first and second meandering segments.

5. A multiple frequency band antenna according to claim 1 wherein the conductive trace first and second meandering segments have different respective electrical lengths.

6. A multiple frequency band antenna, comprising:

a dielectric substrate comprising opposite first and second surfaces;

a feed point disposed on the dielectric substrate; and a meandering conductive trace having a substantially constant first width disposed on the dielectric substrate first surface, comprising:

a first end electrically connected to the feed point and an opposite free end;

an intermediate segment between the first end and the free end, comprising a pair of elongate parallel legs that define a longitudinal direction, wherein the intermediate segment is spaced apart from the conductive trace first end by a distance of less than or equal to about 2 millimeters (mm);

a first meandering segment extending from the first end to the intermediate segment, comprising a pair of elongate converging legs in spaced-apart adjacent relationship with the pair of elongate parallel legs of the intermediate segment, and that converge along the longitudinal direction;

a second meandering segment extending from the intermediate segment to the free end;

wherein the first and second meandering segments are configured to electrically couple with each other such that the antenna resonates within at least two separate and distinct frequency bands;

wherein a portion of at least one of the conductive trace first and second meandering segments has a second width greater than the first width; and a conductive element disposed on the dielectric substrate second surface, wherein the conductive element is configured to parasitically couple with at least one of the conductive trace first and second meandering segments.

7. A multiple frequency band antenna according to claim 6 wherein the conductive element is disposed on the dielectric substrate second surface in overlying juxtaposition with at least one of the conductive trace first and second meandering segments.

8. A multiple frequency band antenna according to claim 6 wherein the conductive trace first and second meandering segments have different respective electrical lengths.

9. A wireless communicator, comprising:

a housing configured to enclose a transceiver that transmits and receives wireless communications signals; and a multiple frequency band antenna electrically connected with the transceiver, comprising:

a dielectric substrate comprising opposite first and second surfaces;

a feed point disposed on the dielectric substrate; and a meandering conductive trace having a substantially constant first width disposed on the dielectric substrate first surface, comprising:

a first end electrically connected to the feed point and an opposite free end;

an intermediate segment between the first end and the free end, comprising a pair of elongate parallel legs that define a longitudinal direction;

a first meandering segment extending from the first end to the intermediate segment, comprising a pair of elongate converging legs in spaced-apart adjacent relationship with the pair of elongate parallel legs of the intermediate segment, and that converge along the longitudinal direction;

a second meandering segment extending from the intermediate segment to the free end;

wherein the first and second meandering segments are configured to electrically couple with each other such that the antenna resonates within two separate and distinct frequency bands; and wherein a portion of at least one of the conductive trace first and second meandering segments has a second width greater than the first width.

10. A wireless communicator according to claim 9 wherein the intermediate segment is spaced apart from the conductive trace first end by a distance of less than or equal to about 2 millimeters (mm).

11. A wireless communicator according to claim 9 further comprising a conductive element disposed on the dielectric substrate second surface, wherein the conductive element is configured to parasitically couple with at least one of the conductive trace first and second meandering segments.

12. A wireless communicator according to claim 11 wherein the conductive element is disposed on the dielectric substrate second surface in overlying juxtaposition with at least one of the conductive trace first and second meandering segments.

13. A wireless communicator according to claim 9 wherein the conductive trace first and second meandering segments have different respective electrical lengths.

14. A wireless communicator, comprising:

a housing configured to enclose a transceiver that transmits and receives wireless communications signals; and a multiple frequency band antenna electrically connected with the transceiver, comprising:

a dielectric substrate comprising opposite first and second surfaces;

a feed point disposed on the dielectric substrate; and a meandering conductive trace having a substantially constant first width disposed on the dielectric substrate first surface, comprising:

a first end electrically connected to the feed point and an opposite free end;

an intermediate segment between the first end and the free end, comprising a pair of elongate parallel legs that define a longitudinal direction, wherein the intermediate segment is spaced apart from the conductive trace first end by a distance of less than or equal to about 2 millimeters (mm);

a first meandering segment extending from the first end to the intermediate segment, comprising a pair of elongate converging legs in spaced-apart adjacent relationship with the pair of elongate parallel legs of the intermediate segment, and that converge along the longitudinal direction;

a second meandering segment extending from the intermediate segment to the free end;

wherein the first and second meandering segments are configured to electrically couple with each other such that the antenna resonates within two separate and distinct frequency bands;

wherein a portion of at least one of the conductive trace first and second meandering segments has a second width greater than the first width; and a conductive element disposed on the dielectric substrate second surface, wherein the conductive element is configured to parasitically couple with at least one of the conductive trace first and second meandering segments.

15. A wireless communicator according to claim 14 wherein the conductive element is disposed on the dielectric substrate second surface in overlying juxtaposition with at least one of the conductive trace first and second meandering segments.

16. A wireless communicator according to claim 14 wherein the conductive trace first and second meandering segments have different respective electrical lengths.

* * * * *